US005831203A

United States Patent [19]

Ewick

[11] Patent Number: 5,831,203

[45] Date of Patent: Nov. 3, 1998

[54] HIGH IMPEDANCE SEMICONDUCTOR BRIDGE DETONATOR

[75] Inventor: David W. Ewick, North Granby, Conn.

[73] Assignee: The Ensign-Bickford Company, Simsbury, Conn.

[21] Appl. No.: 812,662

[22] Filed: Mar. 7, 1997

[51] Int. Cl.[6] ..... F42C 19/12

[52] U.S. Cl. ..... 102/202.5; 102/202.14

[58] Field of Search ..... 102/202.8, 202.7, 102/202.5

[56] References Cited

U.S. PATENT DOCUMENTS

| | | | |
|---|---|---|---|
| 3,366,055 | 1/1968 | Hollander, Jr. | 102/202.7 |
| 4,014,264 | 3/1977 | Bendler et al. | 102/202.7 |
| 4,484,960 | 11/1984 | Rucker . | |
| 4,674,047 | 6/1987 | Tyler et al. . | |
| 4,708,060 | 11/1987 | Bickes, Jr. et al. . | |
| 4,825,765 | 5/1989 | Ochi et al. . | |
| 4,840,122 | 6/1989 | Nerheim . | |
| 4,862,803 | 9/1989 | Nerheim et al. . | |
| 4,869,170 | 9/1989 | Dahmberg et al. | 102/202.5 |
| 4,893,564 | 1/1990 | Ochi et al. . | |
| 4,976,200 | 12/1990 | Benson et al. . | |
| 4,986,183 | 1/1991 | Jacob et al. . | |
| 5,094,167 | 3/1992 | Hendley, Jr. | 102/218 |
| 5,133,257 | 7/1992 | Jonsson . | |
| 5,166,468 | 11/1992 | Atkeson | 102/207 |
| 5,173,569 | 12/1992 | Pallanck et al. . | |
| 5,179,248 | 1/1993 | Hartman et al. . | |
| 5,309,841 | 5/1994 | Hartman et al. . | |
| 5,327,834 | 7/1994 | Atkeson . | |
| 5,355,800 | 10/1994 | Dow et al. | 102/202.2 |
| 5,363,765 | 11/1994 | Aikou et al. . | |
| 5,385,097 | 1/1995 | Hruska et al. . | |
| 5,435,248 | 7/1995 | Rode et al. . | |
| 5,503,077 | 4/1996 | Motley . | |

FOREIGN PATENT DOCUMENTS 9419661 9/1994 WIPO .

OTHER PUBLICATIONS

API "Recommended Practices for Oilfield Explosives Safety" RP 67; First Edition; Mar. 1, 1994.

J. Childs et al "Digidet Delay Detonators: A New Approach to Electronic Delay Blasting"; Jul. 8–13, 1995 Seminar pp. 17–24.

*Primary Examiner*—Charles T. Jordan
*Assistant Examiner*—Christopher K. Montgomery
*Attorney, Agent, or Firm*—Law Ofice of Victor E. Libert; Victor E. Libert; Frederick A. Spaeth

[57] ABSTRACT

A detonator (10) contains an SCB initiator assembly (35) in initiation relation to an ignition charge (18). The SCB initiator assembly (35) contains an initiator element (36) having a bridge (60) of semiconductor material between two conductive lands (62*a*, 62*b*). The bridge (60) provides a resistance of at least about 50 ohms and has a volume between 48,600 cubic microns and 600,000 cubic microns with a typical thickness of two microns. A firing current of more than 200 milliamp provided to the initiator assembly (35) via input leads (26*a*, 26*b*) causes the bridge (60) to initiate the ignition charge (18).

17 Claims, 3 Drawing Sheets

HIGH IMPEDANCE SEMICONDUCTOR BRIDGE DETONATOR

BACKGROUND OF THE INVENTION

1. Field of the Invention

The present invention relates to semiconductor bridge detonators. More particularly, the invention relates to such a detonator having a high impedance, thin-film bridge with certain electrical characteristics for special applications.

2. Related Art

Detonators are used to initiate various types of explosive charges, for example, to initiate boosters for downhole explosive charges in blasting operations. A conventional detonator comprises an elongated shell having one closed end and one open end. An explosive output charge is disposed in the closed end of the shell. An initiation signal transmission line is passed through the open end of the shell and is operatively connected to the output charge, so that the initiation signal can be transferred from the signal transmission line to the output charge to fire the detonator. Some detonators comprise electric initiator elements such as a hot wire, an exploding bridgewire or a semiconductor bridge (SCB) that initiate the output charge. The initiator elements extend between electrical contacts to which lead wires provide an electrical firing signal. The energy of the electrical firing signal is released by the initiator element to initiate the explosive material in the detonator. The quantity of released energy is related to the electrical resistance of the electric initiator element and the current that passes through the initiator element at initiation.

U.S. Pat. No. 4,708,060 to Bickes, Jr. et al, dated Nov. 24, 1987, discloses SCB igniter elements, which are described as comprising an electrical semiconductor material disposed on a non-conductive substrate. The semiconductor material may be, e.g., a layer of n-type silicon that has been doped with phosphorus. As indicated in this Patent, other semiconductor materials and dopants can be used with similar effect. The resistivity of the doped material varies with the dopant level, as is well-understood in the art. Typically, the semiconductor material is disposed on the non-conductive substrate by a chemical vapor deposition process by which the thickness of the material can be precisely controlled. The surface of the non-conductive substrate is usually masked during the deposition process so that the layer of semiconductor material is rendered in an hourglass shape, i.e., it forms two relatively large pads joined together by a small bridge. Two pads of conductive material are then disposed upon the large pads of the semiconductor material and are separated by the bridge of semiconductor material between them. The resistivity of the semiconductor material and the dimensions of the semiconductor bridge between the conductive pads determines the effective resistance that the semiconductor bridge provides between the conductive pads. The Patent teaches a preference for SCBs of low resistance, e.g., no larger than 10 ohms, for safety reasons, i.e., in case the SCB is used with an electrostatic sensitive ignition charge, (see column 7, lines 44–50) and for a reduction in resistivity with an increase in SCB size (see column 7, lines 53–55). The firing data provided pertain to high amperage (e.g., 10 amps and higher), short duration electrical initiation signals of less than 100 microseconds duration (see column 5, line 62 through column 6, line 3). The comparative data of Table 2 are difficult to interpret because SCB1 and SCB2 differ not only in resistance but also in thickness (2 microns vs. 4 microns).

U.S. Pat. No. 5,179,248 to Hartman et al, dated Jan. 12, 1993, relates to a zener diode for protection of SCBs. The zener diode, which is connected across the lands of the SCB, helps to avoid premature energization of the explosive due to electrostatic discharge or other voltages greater than the firing voltage. The Patent specifies a bridge resistance no greater than 1 ohm, as a larger resistance would detrimentally affect the heating of the explosive (see, e.g., column 5, lines 60–66).

The American Petroleum Institute ("API") publication RP 67, entitled "Recommended Practices for Oilfield Explosives Safety", First Edition, Mar. 1, 1994, provides recommended safety practices for electric detonators used in downhole applications with oil field explosives. As these practices apply to electric hot wire and SCB detonators, they require the detonator to have a minimum DC resistance of 50 ohms and a minimum no-fire current of 200 milliampere ("milliamp" or "ma"), i.e., the detonator should have at least a 2-watt initiation threshold. The majority of detonators used in the oil and gas industry today are "resistorized" to meet these requirements, i.e., they typically contain a 1-ohm hot wire and two discrete 25-ohm resistors that are electrically connected in series with a low-resistance hot wire. The discrete resistors are typically positioned in the detonator shell between the closure bushing for the open end of the detonator and an internal rubber plug, and the resistors and internal rubber plug account for a significant portion of the overall length of the detonator. Although exploding bridgewire and exploding foil initiator detonators, which do not need to be "resistorized", are now commercially available to the oil and gas market, their costs are considerably higher and they are not directly compatible with standard field firing systems because they require specialized firing equipment.

SUMMARY OF THE INVENTION

The present invention relates to a semiconductor bridge initiator element comprising an electrically non-conductive carrier substrate. A semiconductor material is disposed on the substrate. Two conductive lands are carried on the substrate in contact with the semiconductor material with a bridge of semiconductor material, i.e., a semiconductor bridge (SCB), extending between them. The SCB has a resistance of at least about 50 ohms. The SCB may have a volume in the range of from about 13,160 to 600,000 cubic micrometers ("$\mu m^3$"), e.g., about 76,000 $\mu m^3$. Further, the SCB may have a length to width ratio in the range of about 1:2 to 1:4.

The invention also provides an initiator module comprising an electrically non-conductive base, a pair of connector terminals mounted in the base, and a semiconductor bridge initiator element, as described above, mounted on the base wherein each connector terminal is electrically connected to a conductive pad on the semiconductor bridge initiator element.

The invention also provides a detonator comprising a housing, an output charge in the housing and an initiator assembly for initiating the output charge. The initiator assembly comprises the initiator module described above. The detonator may comprise an ignition charge in the housing. Preferably, the ignition mixture comprises a static-insensitive composition.

DETAILED DESCRIPTION OF THE INVENTION AND PREFERRED EMBODIMENTS THEREOF

Figure 1:
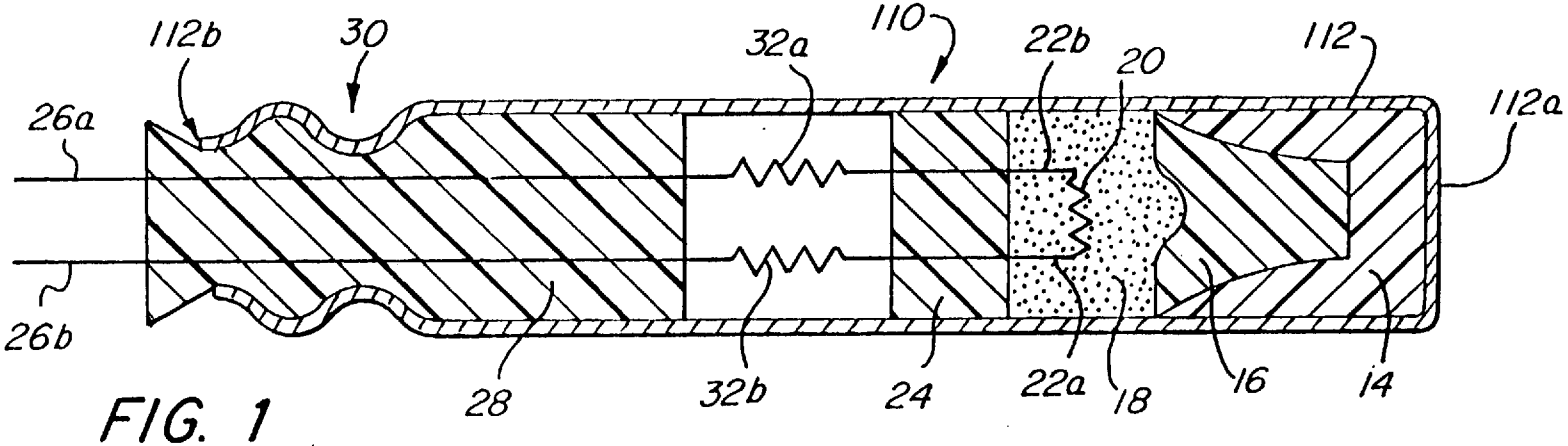
FIG. 1 (PRIOR ART)
FIG. 1 is a schematic cross-sectional view of a prior art hot wire detonator including a pair of internal resistors.

Referring now to FIG. 1 there is shown schematically a prior art hot wire detonator 110 as is in use in oil and gas operations. Detonator 110 comprises a metal detonator shell or housing 112 which is generally cylindrical in configuration and which has a closed end 112*a* and an open end 112*b*. At closed end 112*a* housing 112 contains a base charge 14 that comprises a secondary explosive material. For oil and gas applications, explosive materials that are useful at high temperatures, such as RDX or HNS (hexanitrostilbene), are preferred over others such as, e.g., PETN (pentaerythritol tetranitrate). Tamped into housing 112 adjacent to base charge 14, and thus in signal transfer relation thereto, is an intermediate charge 16 that typically comprises a primary explosive material such as lead azide. Together, base charge 14 and intermediate charge 16 comprise the output charge of the detonator. The output charge generates the explosive detonation output that bursts housing 112 and provides the output signal of the detonator. Adjacent intermediate charge 16 is an ignition charge 18 that preferably comprises a static insensitive material, such as a mixture of boron and ferric oxide. A typical mixture of this type, comprising about 15 percent boron by weight, is disclosed in U.S. Pat. No. 4,484,960, issued to Rucker on Nov. 27, 1984. As is well-known in the art, other reactive mixtures, e.g., $TiH_{1.65}/KClO_4$; $B/BaCrO_4$, etc., can be made relatively insensitive to static electricity as well. Embedded within ignition charge 18 is an initiator element comprising a hot wire 20. Hot wire 20 extends between a pair of hot wire leads 22*a*, 22*b*. Ignition charge 18 is secured in place by an internal plug or bushing 24, through which hot wire leads 22*a* and 22*b* pass.

Electrical input leads 26*a*, 26*b* enter the interior of housing 112 through the open end 112*b*, and are secured therein by a closure bushing 28. Closure bushing 28 is secured within the open end 112*b* of housing 112 by a crimp 30, which also serves to seal the interior of housing 112 against bushing 28, thus helping to protect against the entry of environmental contaminants such as water and oil into the interior of housing 112.

Within housing 112, between closure bushing 28 and internal bushing 24, input leads 26*a*, 26*b* are joined to hot wire leads 22*a*, 22*b* through resistors 32*a*, 32*b*. Typically, resistors 32*a* and 32*b* each provide twenty-five ohms of resistance, thus satisfying one of the American Petroleum Institute's recommended safety criteria. In operation, input leads 26*a*, 26*b* carry an electrical initiation signal to hot wire 20 through resistors 32*a*, 32*b* and hot wire leads 22*a*, 22*b*. The current of the initiation signal generates sufficient heat in hot wire 20 to initiate the boron/ferric oxide ignition charge 18, thus initiating the detonator. The duration of the initiation signal, which in the oil and gas industry is applied as a ramped applied voltage, is generally not less than 100 milliseconds, and may be as long as 3 seconds and, as discussed below, the current level of the initiation signal is small.

In an effort to advance the art of detonators for oil and gas applications, the Applicant attempted to substitute the conventional hot wire 20 with a semiconductor bridge (SCB) initiator module that comprises an SCB initiator element.

In attempting to select an SCB initiator element for a detonator like detonator 110, the Applicant found that an SCB initiator element comprising a conventional 1-ohm SCB measuring 17×36×2 microns (which has been used successfully to initiate ignition charges comprising, e.g., BNCP) was unable to reliably initiate a boron/ferric oxide ignition charge when provided with the 800 milliamp current that is dictated by industry standards as an all-fire current for oil and gas applications. The Applicant found that approximately 50 percent more current was required (i.e., about 1200 milliamp) for such an SCB to initiate the boron/ferric oxide ignition charge, for an initiation power of 1.44 watts. The current necessary to provide 1.44 watts could be reduced by increasing the resistance of the semiconductor bridge. For example, to satisfy the applicable API safety requirements, the conventional 1-ohm, 17×36×2 micron SCB could be doped to provide 50-ohm resistance, but then the 1.44 watt threshold initiation power would be met by a current of only about 170 milliamp, which is less than the 200 milliamp no-fire safety requirement.

The present invention arises from the general knowledge that among SCBs with the same thickness and electrical resistance, larger SCBs required more current to initiate the boron/ferric oxide ignition charge than did smaller SCBs. In other words, the power required to initiate the ignition charge varies with the size of the SCB. The Applicant's experimentation revealed a specific relationship between size limitations of SCBs and initiation threshold currents not previously known or suggested in the art. The Applicant's findings in this regard are summarized in the following TABLE I, which shows the initiation threshold current and power ($W=I^2R$) for four sizes of 1-ohm SCBs (designated A, B, C and D). The "length" dimension indicated in TABLE I is measured between the conductive lands on the SCB element, i.e., from end to end; the width dimension is measured from side to side, i.e., at right angles to the length measurement. If the SCBs were doped to have the resistivity necessary to provide about 50 ohms resistance, they will provide the indicated threshold power with less current, as also shown in TABLE I.

TABLE I

| | 1-Ohm SCBs Dimensions (Micrometers (μm)) (2 μm Thickness) | | | Approx. Ratio of | Initiation Threshold For $B/Fe_2O_3$ | | 50-Ohm Threshold |
|---|---|---|---|---|---|---|---|
| SCB | Length | × | Width | L:W | Current (Amps) | Power (Watts) | Current (Amps) |
| A | 17 | | 36 | 1:2 | 1.21 | 1.5 | 0.173 |
| B | 47 | | 140 | 1:3 | 1.51 | 2.3 | 0.214 |
| C | 90 | | 270 | 1:3 | 2.07 | 4.3 | 0.29 |
| D | 100 | | 380 | 1:4 | 2.37 | 5.6 | 0.33 |

The data of TABLE I allow the Applicant to identify the critical size limitations for 50-ohm SCBs that have firing characteristics that satisfy API requirements. Specifically, the data of TABLE I show that a 50-ohm SCB must have a volume of at least about 47×140×2 μm=13,160 cubic microns to have an initiation threshold current that exceeds the API safety criterion of 2 watt, 200 milliamp no-fire. Extrapolation of these data suggests that 50-ohm SCBs as large as about 600,000 cubic microns can be used. SCBs in excess of 600,000 cubic microns will require more than 800 milliamps to initiate the boron/ferric oxide ignition charge, a current level that exceeds a useful limit detonator all-fire current. Preferably, as reflected in TABLE I, the SCBs of the present invention have a thickness of about 2 μm and a length to width ratio in the range of about 1:2 to 1:4.

Figure 2:
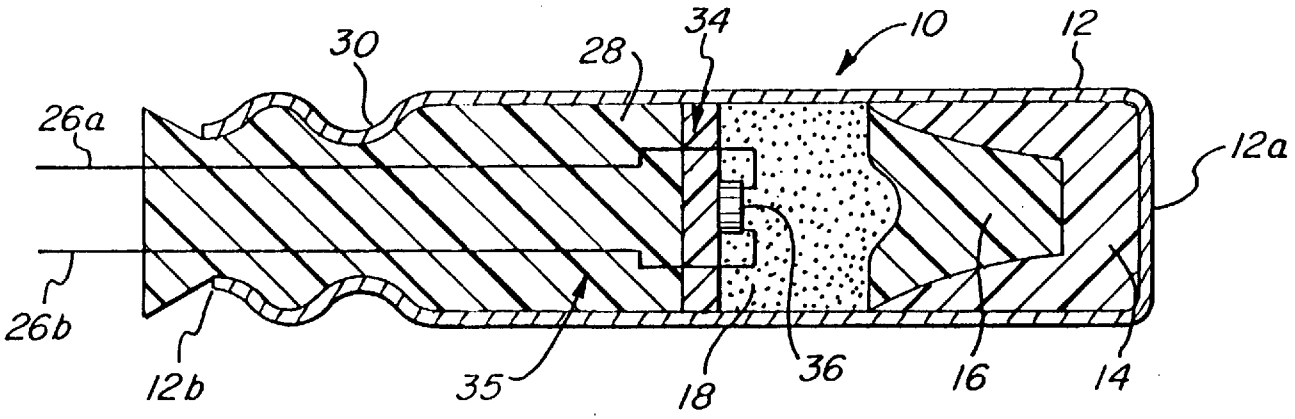
FIG. 2 is a schematic cross-sectional view of a detonator in accordance with a particular embodiment of the present invention.

An SCB detonator in accordance with the present invention is shown schematically in FIG. 2. Detonator 10 comprises a housing 12 that has a generally cylindrical configuration with a closed end 12*a* and an open end 12*b* and contains the same output charge as a conventional detonator 110 (FIG. 1), i.e., a base charge 14 and an intermediate charge 16. An optional, preferably static-insensitive ignition charge 18 is loosely disposed in housing 12 adjacent to intermediate charge 16. Input leads 26*a* and 26*b* extend into the interior of housing 12 and are secured therein by a closure bushing 28 and crimp 30. Input leads 26*a* and 26*b* carry an electrical initiation signal to an initiator module 34. Initiator module 34 comprises a semiconductor bridge initiator element 36, which is shown and described in greater detail in FIGS. 3 through 4B and the accompanying text. When the electrical initiation signal is transferred via input leads 26*a* and 26*b* to initiator module 34, the SCB initiator element 36 initiates the ignition charge 18, thus initiating the output charge of the detonator. Together, bushing 28 (with leads 26*a*, 26*b* therein) and initiator module 34 comprise an initiator assembly 35. In alternative embodiments of the invention, the ignition charge can be omitted, and the SCB can directly initiate the intermediate charge.

As indicated above, SCB initiator element 36 is a high impedance component which is manufactured to provide a resistance of at least about 50 ohms, i.e., 55±5 ohms. Accordingly, detonator 10 satisfies the safety requirement promulgated by the American Petroleum Institute without the need to "resistorize" the initiator element, i.e., add one or more discrete resistors to the detonator circuitry, as was done in the prior art. Thus, with reference to prior art detonator 110 (FIG. 1), resistors 32*a* and 32*b* are not required in detonator 10 (FIG. 2) according to the present invention. In the absence of resistors 32*a* and 32*b*, the internal bushing 24 is no longer required. The elimination of resistors 32*a* and 32*b* and internal bushing 24 allows detonator 10 to be significantly shorter than the prior art detonator 110 since initiator module 34 occupies significantly less space in a detonator housing than resistors 32*a*, 32*b* and internal bushing 24. This yields greater manufacturing efficiency, lower costs and greater flexibility in the design of other devices with which the detonator will be used. Optionally, one aspect of the invention can be described as excluding discrete resistors from the detonator circuitry.

Figure 3:
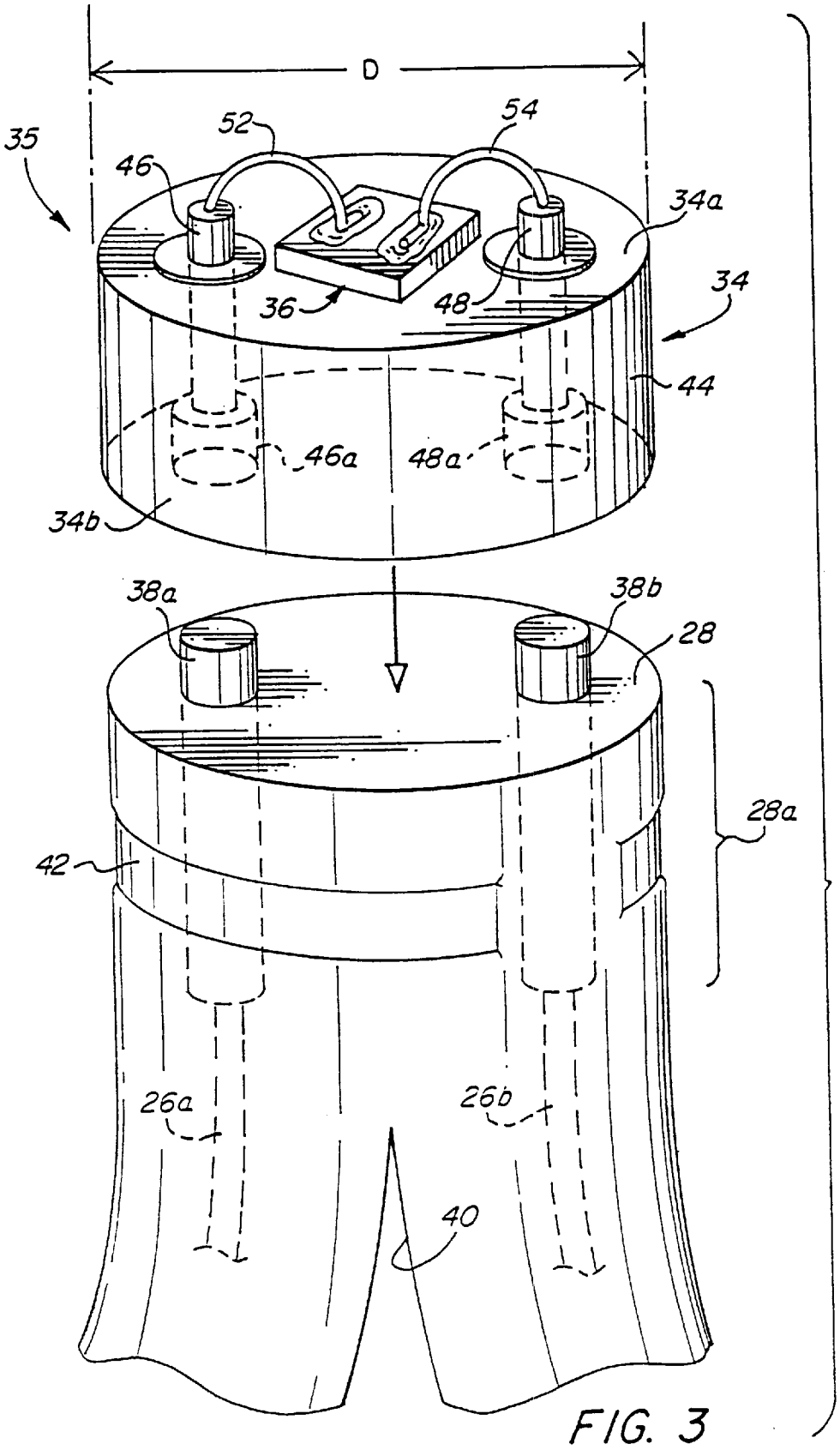
FIG. 3 is an enlarged perspective view of the initiator assembly of the detonator of FIG. 2.

Initiator module 34 and the bushing 28 (which, together with input leads 26*a*, 26*b* comprise an initiator assembly) are shown in greater detail in FIG. 3. Bushing 28 has a head portion 28*a* within which connector studs 38*a* and 38*b* are disposed. Bushing 28 is preferably formed from an elastic synthetic polymeric material. The head portion 28*a* of bushing 28 is generally cylindrical and it has a diameter that corresponds approximately to the interior diameter of the detonator housing (not shown), e.g., about 0.233 inch (5.9 mm). The remainder of bushing 28 is split at seam 40 to facilitate the insertion of the exposed ends of electrical leads 26*a* and 26*b* into the open ends of connector studs 38*a* and 38*b*. Clamp ring 42 applies a clamping pressure on the head portion 28*a* of bushing 28 to help secure leads 26*a* and 26*b* in connector studs 38*a* and 38*b*, respectively.

Initiator module 34 comprises a generally cylindrical non-conductive pill 44 that may be formed from a polymeric material, e.g., an epoxy resin. Connector terminals 46 and 48 extend through pill 44 to top surface 34*a* and bottom surface 34*b*. Near bottom surface 34*b*, connector terminals 46 and 48 form coupling recesses 46*a*, 48*a*, which are dimensioned and configured to engage connector studs 38*a* and 38*b* on bushing 28. The SCB initiator element 36 is adhered to the top surface 34*a* of pill 44, preferably between connector terminals 46 and 48, in any convenient manner, e.g., by epoxy adhesive. Two 5 mil (0.005 inch) aluminum bond wires 52, 54 extend between the exposed ends of connector terminals 46 and 48 and associated conductor pads (not shown) on SCB initiator element 36, and may be sonically welded in place at each end by a process well-known in the art.

Like bushing 28, pill 44 is generally cylindrical and has a diameter D that corresponds to the internal diameter of the detonator housing (not shown). Preferably, connector studs 38*a*, 38*b* and coupling recesses 46*a*, 48*a* are configured so that once studs 38*a* and 38*b* are inserted into recesses 46*a*, 48*a*, they will be securely retained therein, e.g., by a locking mechanism such as a leaf spring detent on studs 38*a*, 38*b* and corresponding grooves in coupling recesses 46*a*, 48*a*. Thus, initiator module 34 and bushing 28 (including leads 26*a*, 26*b*) will be joined together to constitute initiator assembly 35 and to provide electrical continuity between leads 26*a*, 26*b* and bond wires 52, 54. Initiator assembly 35 allows an initiation signal to be conveyed from an external device to the interior of the detonator and, in particular, to the ignition charge.

Figure 4A:
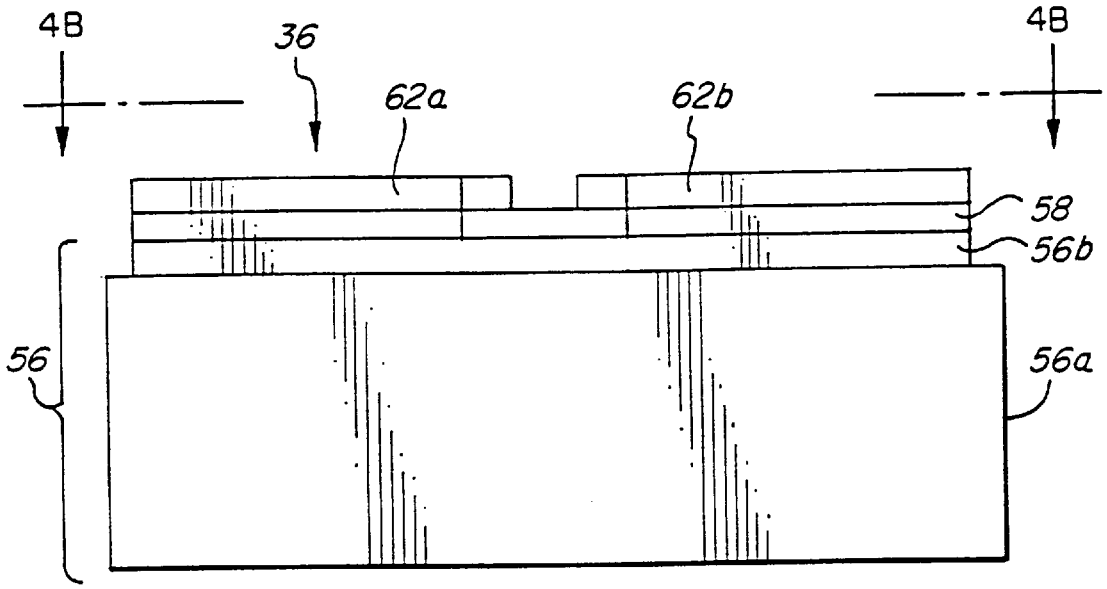
FIG. 4A is an enlarged elevational view of the semiconductor bridge (SCB) initiator element in the initiator assembly of FIG. 3.
Figure 4B:
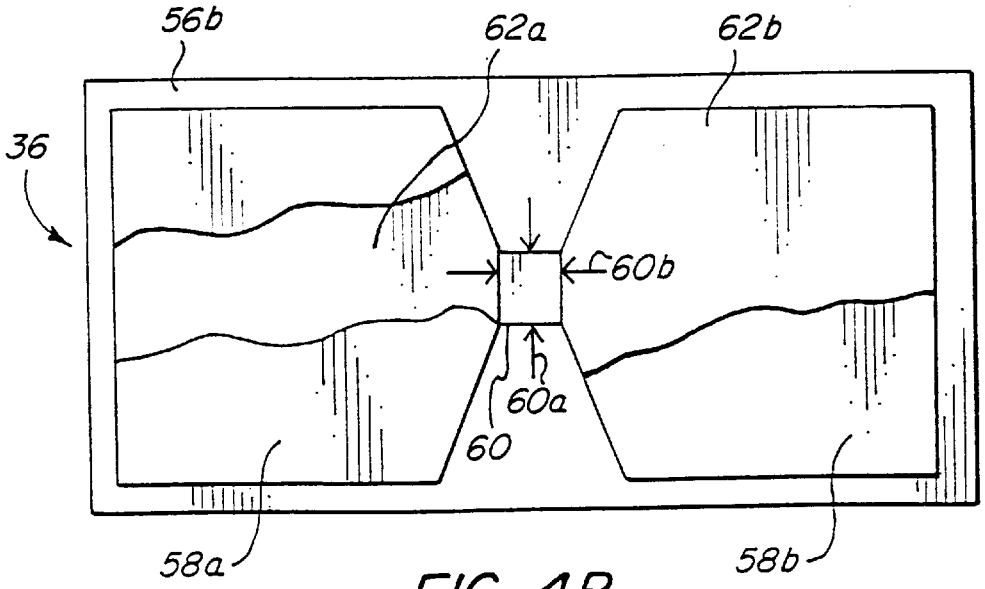
FIG. 4B is a view of the SCB initiator element of FIG. 4A taken along line 4B—4B.

Referring now to FIGS. 4A and 4B, SCB initiator element 36 is seen to comprise a non-electrically conducting substrate 56 that may comprise a silicon base 56*a* with a layer of silicon dioxide 56*b*. (Sapphire is known in the art for use as a substrate, and other materials such as alumina might be used as well. Silicon is preferred because of its favorable thermal properties.) On silicon dioxide layer 56*b* is a 2-micron thick layer of semiconductor material 58 which may comprise a phosphorus-doped polysilicon semiconductor layer in an hourglass configuration having two spaced apart pads 58*a*, 58*b* (FIG. 4B) joined by a thin-film bridge 60. Bridge 60 has a width 60*a*, a length 60*b* and a thickness equal to the thickness of layer 58. A typical thickness for semiconductor layer 58 is two microns. The level of doping in layer 58, which determines the resistivity of the semiconductor material, is coordinated with the planned length 60*b* (FIG. 4B) and width 60*a* and thickness of the semiconductor bridge 60 that will extend between the metallized lands to provide the desired resistance between them. A typical size for a semiconductor bridge in accordance with the present invention is about 100 (length)×380 (width)×2 microns (volume=76,000 cubic microns). Electrically conductive metallized lands 62*a* and 62*b* (seen partially broken away in FIG. 4B for purposes of illustration) respectively cover pads 58*a*, 58*b* of the semiconductor layer. Electrically conductive bond wires 52, 54 (FIG. 3) are connected to metallized lands 62*a* and 62*b*, respectively. The electrical resistance between bond wires 52, 54 is substantially equal to the electrical resistance provided by bridge 60 between lands 62*a* and 62*b*. The resistance provided by bridge 60 is the resistance attributed to the SCB initiator element.

SCB initiator element 36 may be manufactured by well-known procedures involving photolithographic masking, chemical vapor deposition, etc., to precisely control the thickness, configuration and doping concentration of each layer of material, yielding highly consistent performance for large numbers of SCBs.

At the stated 50-ohm resistance, the Applicant found that for the SCB measuring 100×380×2 microns, about 0.34 amp of current, or 5.6 watts of power, was required for this SCB element to reliably initiate the ignition charge. This current requirement is consistent with the industry standard requirement for a 200 milliamp no-fire current. In addition, it is consistent with the industry requirement for an all-fire current level of at or below 800 milliamp. For about ten test SCB elements in accordance with the present invention, an all-fire current of 670 milliamp and a no-fire current of 430 milliamp was found. Based on the Applicant's findings set forth in the above TABLE I, it is believed that bridge 60 of the 50-ohm SCB element must have a volume (given a uniform 2 micron thickness) of at least about 13,160 $\mu m^3$, and preferably has a volume of from 48,600 to 300,000 $\mu m^3$ or, more preferably, about 76,000 $\mu m^3$, to initiate the ignition charge while meeting the desired no-fire current criterion. In order to assure that the minimum resistance is met, semiconductor layer 58 may be manufactured so that bridge 60 provides a DC resistance of 55±5 ohms.

In the manufacture of detonator 10, base charge 14 and intermediate charge 16 are pressed into the empty housing 12. The ignition charge 18 is loosely disposed within housing 12 on top of intermediate charge 16, but is not compacted therein. Separately, input leads 26*a* and 26*b* are secured in bushing 28 and initiator module 34, which is manufactured as described above, is secured onto bushing 28 by inserting connector studs 38*a* and 38*b* into coupling recesses 46*a*, 48*a*, to form the initiator assembly. Then, the initiator assembly is inserted into the housing to a depth at which SCB initiator element 36 contacts ignition charge 18 with a minimum of compressive force. Typically, a maximum pressure of approximately 1,000 psi is applied to the initiator assembly. When the initiator assembly is in place, crimp 30 is formed in housing 12 to retain bushing 28 in place.

When an electrical initiation signal of adequate amperage is received from leads 26*a* and 26*b*, bridge 60 (FIG. 4B) vaporizes, initiating ignition charge 18, which in turn initiates detonator 10.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A semiconductor bridge initiator element, comprising:

an electrically non-conductive carrier substrate;

a semiconductor material disposed on the substrate; and two conductive lands in contact with the semiconductor material and having a bridge of semiconductor material (SCB) extending between them, the SCB having a resistance of at least about 50 ohms.

2. The element of claim 1 wherein the SCB has a volume in the range of from about 13,160 $\mu m^3$ to about 600,000 $\mu m^3$.

3. The element of claim 2 wherein the SCB has a thickness of about 2 $\mu m$.

4. The element of claim 1, claim 2 or claim 3 wherein the SCB has a length to width ratio in the range of from about 1:2 to 1:4.

5. The element of claim 1, claim 2 or claim 3 wherein the SCB has a volume of about 76,000 $\mu m^3$.

6. An initiator module comprising:

an electrically non-conductive base;

a pair of connector terminals mounted in the base; and a semiconductor bridge initiator element of claim 1, claim 2, or claim 3 mounted on the base;

wherein each connector terminal is electrically connected to a conductive pad on the semiconductor bridge element.

7. The initiator module of claim 6 comprising an SCB having a volume of about 76,000 $\mu m^3$.

8. In a detonator comprising a housing, an output charge in the housing and an initiator assembly for initiating the output charge, the improvement comprising that the initiator assembly comprises an initiator module as described in claim 6.

9. The detonator of claim 8 wherein the SCB has a volume of about 76,000 $\mu m^3$.

10. The detonator of claim 8 further comprising an ignition charge in the housing between the initiator assembly and the output charge.

11. The detonator of claim 10 comprising a static-insensitive ignition composition.

12. The initiator module of claim 6 wherein the SCB has a length to width ratio in the range of from about 1:2 to 1:4.

13. The initiator module of claim 7 wherein the SCB has a length to width ratio in the range of from about 1:2 to 1:4.

14. The detonator of claim 8 wherein the SCB has a length to width ratio in the range of from about 1:2 to 1:4.

15. The detonator of claim 9 wherein the SCB has a length to width ratio in the range of from about 1:2 to 1:4.

16. The detonator of claim 10 wherein the SCB has a length to width ratio in the range of from about 1:2 to 1:4.

17. The detonator of claim 11 wherein the SCB has a length to width ratio in the range of from about 1:2 to 1:4.

* * * * *